US005651024A

United States Patent [19]

Gensini et al.

[11] Patent Number: 5,651,024

[45] Date of Patent: Jul. 22, 1997

[54] COOLED BOTTOM ELECTRODE FOR A DIRECT CURRENT ELECTRIC FURNACE

[75] Inventors: Gianni Gensini, S. Stefano Di Buia; Milorad Pavlicevic, Udine, both of Italy

[73] Assignee: Danieli & C. Officine Meccaniche SpA, Buttrio, Italy

[21] Appl. No.: 431,565

[22] Filed: Apr. 27, 1995

[30] Foreign Application Priority Data

May 11, 1994 [IT] Italy ..... UD94A0082

[51] Int. Cl.[6] ..... H05B 7/00

[52] U.S. Cl. ..... 373/72; 373/108

[58] Field of Search ..... 373/72, 71, 94, 373/102, 108

[56] References Cited

U.S. PATENT DOCUMENTS

| | | | |
|---|---|---|---|
| 4,125,737 | 11/1978 | Anderson | 373/72 |
| 4,592,066 | 5/1986 | Repetto et al. | 373/72 |
| 4,628,516 | 12/1986 | Voss-Spilker et al. | 373/72 |
| 4,637,033 | 1/1987 | Buhler | 373/72 |
| 4,697,273 | 9/1987 | Cordier | 373/72 |
| 4,715,041 | 12/1987 | Buhler et al. | 373/72 |
| 4,982,411 | 1/1991 | Michelet et al. | 373/72 |
| 5,410,564 | 4/1995 | Takashiba et al. | 373/102 |

FOREIGN PATENT DOCUMENTS

| | | |
|---|---|---|
| 178981 | 9/1985 | European Pat. Off. . |
| 449258 | 10/1991 | European Pat. Off. . |
| 474883 | 3/1992 | European Pat. Off. . |
| 2437760 | 9/1978 | France . |
| 1162045 | 8/1969 | United Kingdom . |
| 2149279 | 10/1984 | United Kingdom . |
| 21845276 | 3/1986 | United Kingdom . |

*Primary Examiner*—Tu B. Hoang

*Attorney, Agent, or Firm*—Antonelli, Terry, Stout & Kraus, LLP

[57] ABSTRACT

A cooled bottom electrode for a direct-current electric furnace includes one or more steel bars incorporated in a refractory hearth of the furnace and having at least its upper end in contact with the bath of molten metal within the furnace, at least a first upper liquid part and at least a second lower solid part being defined along the steel bar and being divided by a separation zone, the lower solid part being associated with cooling elements. The cooling elements are copper cooling means elements introduced in cooperation with the solid part of the steel bar and being inserted at least therewithin and extending at least partly within the bar and towards the inside of the furnace. The copper cooling elements cooperate with a cooling-water system positioned below the bar and in cooperation therewith.

17 Claims, 2 Drawing Sheets

COOLED BOTTOM ELECTRODE FOR A DIRECT CURRENT ELECTRIC FURNACE

BACKGROUND OF THE INVENTION

This invention concerns a cooled bottom electrode for a direct-current electric furnace for the melting and refining of metallic alloys which are advantageously iron-based.

The invention is applied to direct-current electric furnaces which are used for the melting and refining of metals and which comprise at least one upper electrode inserted into the furnace from above and a plurality of bottom electrodes incorporated in the refractory hearth of the furnace.

The invention concerns an improvement of the structure of the bottom electrodes so as to achieve an improvement and an increase of the efficiency of the cooling action of the bottom electrodes.

This leads to an improvement of the operation of the furnace in terms of productive efficiency and of the working life of the electrodes and prevents possible operational accidents and enables still further advantages to be achieved.

Direct-current electric furnaces typically contain an upper electrode, which generally consists of graphite, is associated with the furnace roof and extends into the furnace, and also contain a plurality of electrodes associated with the hearth of the furnace so as to close the electrical circuit.

In direct-current electric furnaces the bottom electrodes are most likely the most delicate component mainly owing to the fact that they are traversed by currents of a very great intensity and undergo intense thermal stresses.

Various types of these bottom electrodes have been developed, and each type possesses its own specific advantages and drawbacks.

For instance, these bottom electrodes have been embodied in the form of metallic bars incorporated in the refractory hearth of the furnace and extending at their lower end at least partly outside the furnace itself.

The number of these bars and their arrangement, which is advantageously symmetrical in relation to the centre of the furnace, depend on the power of the furnace and on the conformation of its hearth.

According to another type of bottom electrode these metallic bars can be divided into a plurality of billets, which have a very small diameter and are fixed at their lower end to a common plate, which is generally air-cooled and is connected by water-cooled conductors to the electricity supply.

Each electrode unit may consist, instead of billets, of a plurality of metallic fins welded to a common metallic support and arranged in cooperation with other electrode units so as to form a ring which is advantageously concentric with the furnace.

Another approach to their embodiment has the hearth of the furnace consisting of a conductive material for the passage of the direct current through the hearth.

According to the state of the art the electrodes of a bar type can be made of steel and copper or wholly of steel.

The upper part of these bars, as it is in contact with the bath of molten metal, melts down to a certain height.

Depending on the efficiency of the cooling, the bar has an upper liquid part and a lower solid part, the parts being divided by a separation zone.

With this type of bottom electrode the main problem is to develop a cooling system able to ensure along the height of the bar a solid part reaching as high as possible, even under the conditions of the high electrical load conducted by these bottom electrodes.

This is necessary, amongst other reasons, so as to prevent the formation of possible routes of escape for the liquid metal.

Various solutions have been disclosed for achieving a high thermal efficiency of the action to cool the bottom electrodes.

In EP-A-0474883 the bottom electrodes, which consist of metallic rods of a small diameter, are assembled in a plurality of electrode units, each of which includes a common conductor plate to which are fitted all the electrodes of the specific electrode unit. This document discloses the cooling of the bottom electrodes by means of the circulation of a forced draught between the plates to which the electrodes are fitted and the plate fitted below the hearth of the furnace.

U.S. Pat. No. 4,592,066 includes a bottom electrode consisting of a metallic plate inserted centrally into the hearth of the furnace; to the lower surface of the plate is fixed a bar which extends downwards out of the hearth.

The part of the bar outside the furnace is surrounded by a sleeve, in which cooling water is fed.

GB-A-1,162,045 includes a bottom electrode consisting of two parts, an upper part and a lower part connected together. The upper part in contact with the bath of molten metal consists of a metal which is the same as that being melted, whereas the lower part, which is not in contact with the bath, consists of a material possessing properties of high electrical and heat conductivity, such as copper for instance.

According to this document the lower part has the purpose of removing heat from the electrode, and its bottom end, which protrudes out from the hearth of the furnace, can be shaped in various ways, for instance as a plate, so as to increase its radiant surface.

EP-A-0449258 discloses a furnace having bottom electrodes of which the part protruding downwards from the hearth is associated with a cooling-water box connected to means that feed and discharge the cooling water.

None of these systems of the state of the art has been able to ensure the achievement of a sufficient solid level of the steel bar incorporated in the refractory hearth owing to the high thermal resistance provided by the steel part of the bar.

SUMMARY OF THE INVENTION

The present applicants have therefore come to the conclusion that, so as to improve the efficiency of the action of cooling the bottom electrodes, it is necessary to increase overall the thermal conductivity of the bars acting as bottom electrodes so that these bars will reduce as much as possible the molten part of the electrode; for this purpose the present applicants have designed, tested and embodied this invention.

The purpose of the invention is to improve the efficiency of the action to cool the bottom electrode embodied in the form of a metallic bar in order to ensure the maintaining of a sufficient height of the part of the electrode remaining solid even where the electrical load is very high.

This improvement of the efficiency of the cooling according to the invention has to ensure at the same time the maintaining of conditions of excellent thermal and electrical conductivity in the zone uniting the cooled part and uncooled part of the bar.

According to the invention the improvement of the efficiency of the cooling of the bottom electrode is achieved by introducing a plurality of copper cooling means from below into the steel bar acting as the electrode.

These cooling means consist of rods having a cylindrical, polygonal or star-shaped profile or another desired geometric configuration, the rods being inserted into the steel bar so as to form a combined copper-steel structure.

These cooling means can also be embodied in the form of columns, which are possibly arcuate and possibly associated with other analogous columns or with rods.

Moreover, the copper cooling means may consist of one single copper body positioned within the steel bar and having a heat exchanger surface including surface roughnesses with a view to increasing the heat exchange with the steel portion.

These copper cooling means are made an integral part of the steel bar and are inserted up to a height which is in the vicinity of the desired zone of separation between the solid part and liquid part of the bar.

The height of the copper cooling means as measured from the bottom of the shell of the furnace may range between a minimum of 30 mm. and a maximum of 800 mm.

According to a first embodiment the copper cooling means consist of a plurality of cooling rods having a desired geometric conformation and starting from a common copper base which is strongly cooled.

According to another embodiment the copper cooling means consist of a plurality of annular columns or spiral elements starting from a strongly cooled common base.

The common base in both embodiments includes heat exchanger means of a high efficiency.

The copper cooling means may have a constant section or a tapered conformation.

Likewise, the annular columns may have a constant section or a section becoming narrower, such as a truncated cone, for instance.

According to the invention the copper cooling means are closely associated with a female seating included in the bar forming the electrode, so that the thermal contact is without any break of continuity.

In order to obtain this, when the female seating in the bar forming the electrode has been embodied, the copper is poured in under a vacuum so as to form the copper cooling means.

According to a variant an alloy of copper or of iron is included between the female seating in the bar forming the electrode and the copper annular columns, so that an intimate contact is obtained between the two faces of the seating and the intermediate thermal and electrical connecting element.

According to another variant the two faces of the seating can be solidly fixed together by melting under vacuum or by ultrasonic welding or else by pressure plus heating and welding by diffusion at a high temperature.

By means of this configuration, seeing that it is known that copper has a thermal conductivity up to ten times greater than the thermal conductivity of steel, it is possible to extend upwards, along the copper cooling means, the action to cool the heat exchanger means without impairing in any way the properties of electrical conductivity of the electrode.

In other words, by means of the invention a structure is created which includes overall values of thermal conductivity greater than those of a structure wholly consisting of steel.

By increasing the overall thermal conductivity of the bottom electrode, and, in particular, by increasing the thermal conductivity of the bottom electrode along its height substantially up to the limit defined by the zone of separation between the solid and liquid parts, the efficiency of the cooling action is increased and leads to the raising of that separation limit in proportion to the quantity of copper introduced.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
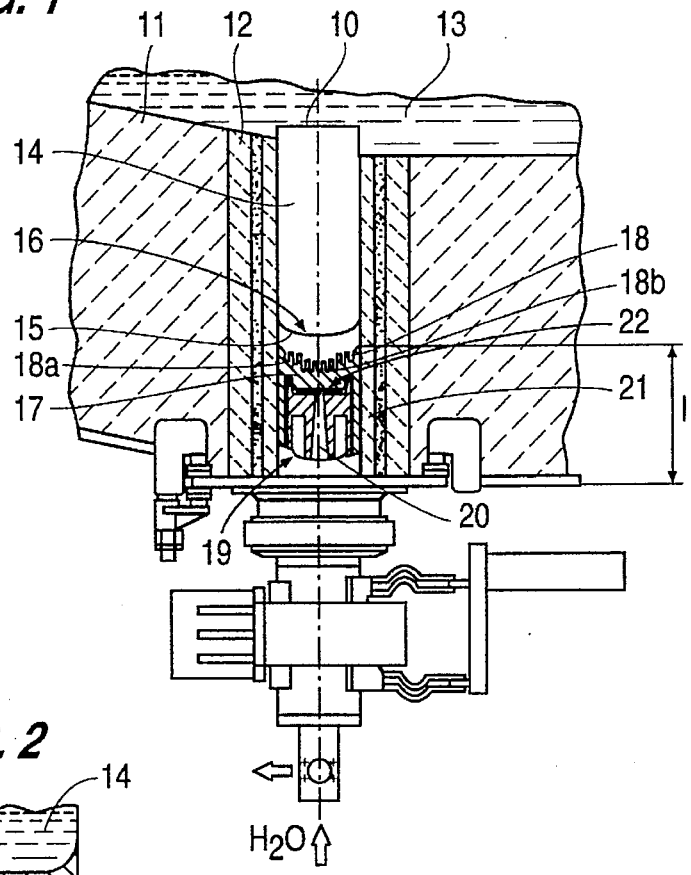
FIG. 1 shows a lengthwise section of the cooled bottom electrode according to the invention.

In FIG. 1 a bottom electrode consists of a steel bar 10 incorporated in a refractory hearth 11 of a normal direct-current electric furnace.

The steel bar 10 in the refractory hearth 11 is surrounded by at least one row of refractory annular bricks referenced with 12.

The steel bar 10 has its upper end in contact with a bath of molten metal 13 (shown partly) in the furnace.

This contact with the molten metal 13 together with the Joule effect caused by the passage of the high currents along the bar 10 itself causes the formation along the bar 10 of a liquid upper part 14 and a solid lower part 15, these parts being separated by an interface zone referenced with 16.

According to the invention, as disclosed in the embodiment of FIG. 1, copper cooling means 17 are associated with the inside of the solid part 15 of the steel bar 10 and cooperate at their lower end with a high efficiency cooling system.

These copper cooling means 17 consist of copper elements having a desired configuration, structure and height and are inserted into the steel bar 10 so as to form a steel-copper binomial having a thermal conductivity greater than an element consisting wholly of steel.

These copper cooling means 17 have a height "1", as measured from the bottom of the shell of the furnace; this height "1" will depend on the desired height of the zone of separation 16 between the solid part 15 and liquid part 14 and will depend on the constructional parameters of the furnace and may range from 30 mm. to 700 mm., but preferably from 300 to 600 mm.

Figure 7:
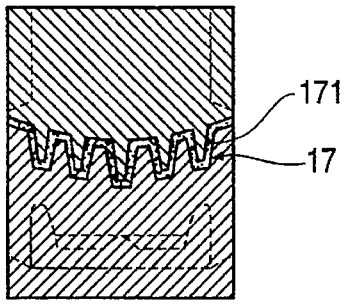
FIG. 7 shows a connection variant.

In the example of FIGS. 1 and 7 the cooling means 17 consist of annular or toric columns 18 having the same height or different heights.

According to an advantageous embodiment the outer annular columns 18*a* are higher than the inner annular columns 18*b* so as to keep the outer part of the bar 10 cooler.

These annular columns 18 have a height which extends substantially to the vicinity of the desired zone of separation 16 between the liquid part 14 and the solid part 15.

The surface of separation between the copper part and the steel part has a superficial roughness 17*a* so as to increase the heat exchange surface.

According to a variant which is not shown, the interface between the copper part 17 and the steel part 15 may consist of a continuous surface, possibly formed as an arc of a circle, which includes surface roughnesses.

According to the embodiment of FIG. 7 the copper part 17 includes annular elements formed as a truncated cone together with a filling 171 suitable to ensure the desired thermal and electrical connection.

The copper cooling means 17 are associated directly at their lower end with a cooling-water system 19 for the cooling of the bottom electrode; in the example shown this cooling system 19 includes a central pipe 20 for the discharge of water and an outer annular pipe 21 to feed water.

Between the central pipe 20 for the discharge of water and the outer annular pipe 21 to feed water, the cooling water has to follow an obligatory path 22 so as to increase the heat exchange surfaces between the cooling system 19 and the copper cooling means 17.

Figure 9:
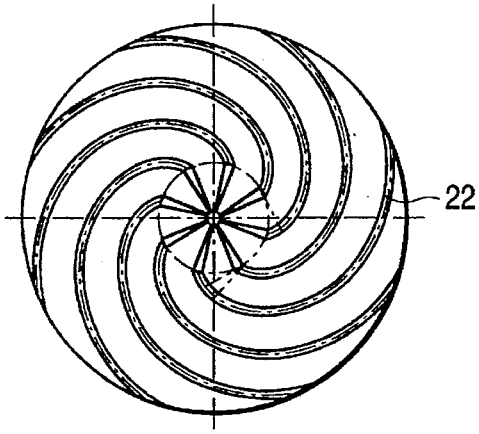
FIG. 9 shows in an enlarged scale the development of a path of the cooling water system.

This obligatory path 22 includes separating baffles and advantageously has a spiral development (FIG. 9) to improve heat exchange.

This obligatory path 22 may also have a development coordinated with the different heights of the annular copper columns 18.

When the outer annular pipe 21 enters the obligatory path 22, it is deviated according to the conformation of an overturned bottom of a bottle used to contain sparkling wine, with a considerable acceleration of the fluid so as to improve the thermal effect.

The cross-section of the passage in this portion shaped as an overturned bottom of a bottle is reduced to a height of a few millimeters, and this cross-section at the perpendicular point "S" has a height between 1.0 and 6.0 mm.

Figure 2:
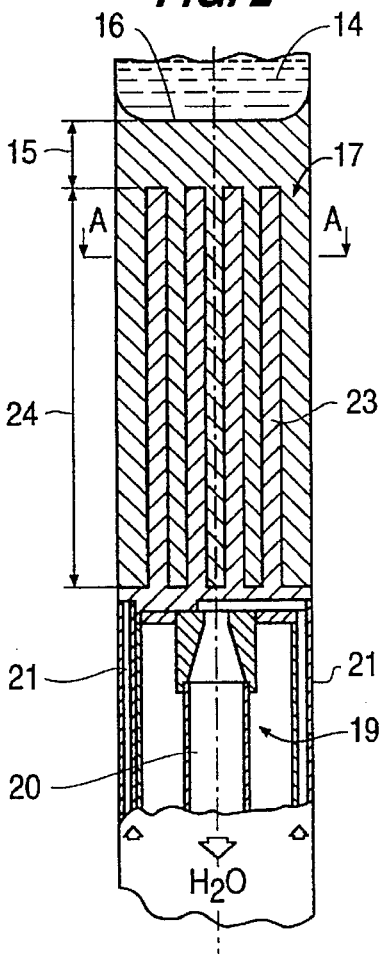
FIG. 2 shows in an enlarged scale with a variant a detail of the bottom electrode of FIG. 1.
Figure 3:
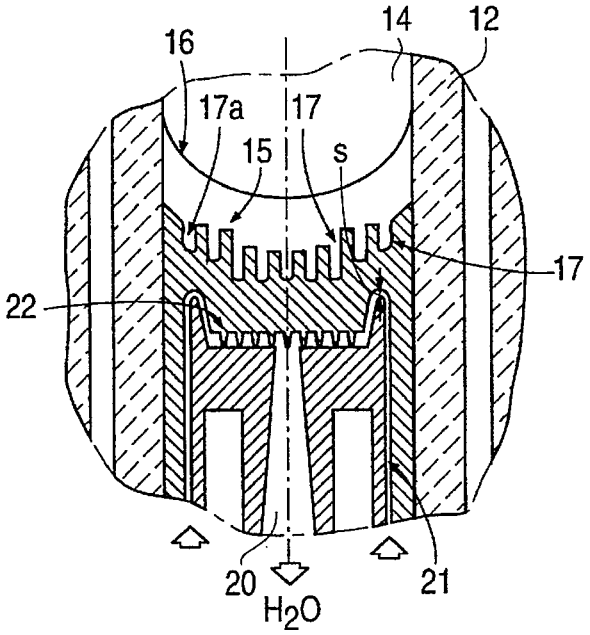
FIG. 3 shows in an enlarged scale a detail of FIG. 1.

In the embodiment shown in FIG. 2 the copper cooling means 17 arrange that a plurality of copper rods 23 associated with the cooling system 19 is included within the solid part 15 of the steel bar 10.

These rods 23 have a height or length 24 which varies between 10 and 200 mm., depending on the case in question.

Figure 4:
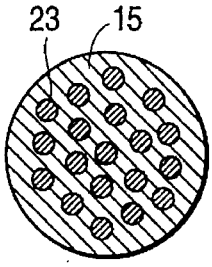
FIG. 4 shows in a reduced scale a section along the line A—A of FIG. 2.
Figure 6:
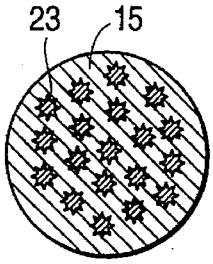
FIG. 6 shows another variant of FIG. 4.
Figure 8:
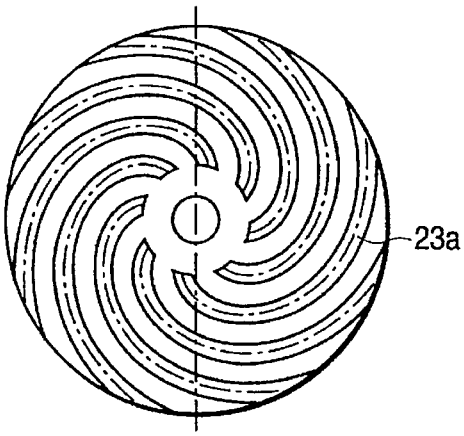
FIG. 8 shows another variant of FIG. 4.
Figure 10:
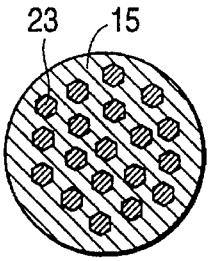
FIG. 10 shows another variant of FIG. 4.

These rods 23 may have a cylindrical conformation, as shown in FIG. 4, or else a regular polygonal (FIG. 10) or star-shaped conformation (FIG. 6) or a conformation of an arc of a circle (FIG. 8) or concentric rings or another desired geometric conformation.

Figure 5:
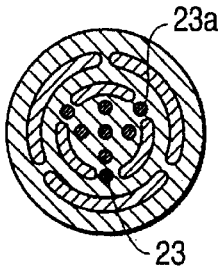
FIG. 5 shows a variant of FIG. 4.

According to the variant of FIG. 5, columns shaped as an arc of a circle 23*a* may be included and be associated with cylindrical rods 23.

The structure of the bottom electrode according to the invention enables the properties of thermal conductivity of the electrode to be increased and the electrical resistance of the bar 10 to be reduced.

In the structure of the bottom electrode of FIG. 2 (but the same considerations can be applied also to the structure of FIG. 1) there are definable along the height of the steel bar 10 not only the liquid part 14 and the solid part 15 but also at least one zone 24 which comprises in determined proportions steel in the solid state and copper; the inclusion of this zone 24, which may extend along a long segment, makes possible an overall increase of the thermal conductivity of the steel bar 10, at least in that zone 24.

The number of copper rods 23 and their dimensions, that is to say, the quantity of copper in a cross-section as compared to the quantity of steel in the same cross-section, enable the value of equivalent thermal conductivity of the bar 10 to be varied.

In this way it is possible to obtain a solid part 15 which extends to a higher level along the bar 10, and within given limits this level can be obtained to a desired extent, while designing the electrode, on the basis of the quantity of copper employed.

We claim:

1. Cooled bottom electrode for a direct-current electric furnace, comprising at least one steel bar incorporated in a refractory hearth of the furnace, at least a first upper liquid part of the steel bar and at least a second lower solid part of the steel bar being defined along the steel bar and being divided by a separation zone, at least an upper end of the first upper liquid part of the steel bar being in contact with a bath of molten metal, and at least one copper cooling element extending at least partly within the solid part of the bar and towards the inside of the furnace, the copper cooling element being connected to a cooling-water system positioned below the bar, wherein at least an upper part of the at least one copper cooling element is provided in the refractory hearth and extends upwardly from a bottom of a shell of the furnace.

2. Electrode as in claim 1, in which the at least one copper cooling element has the shape of elongate bodies.

3. Electrode as in claim 2, in which a height of the at least one copper cooling element as measured from the bottom of the shell of the furnace is between 30 mm and 700 mm.

4. Electrode as in claim 1, in which the height of the copper cooling elements as measured from the bottom of the shell of the furnace is between 300 mm and 600 mm.

5. Electrode as in claim 1, in which the at least one cooling element consists at least partly of a plurality of rods having a cylindrical, polygonal, or starshaped geometric cross-section.

6. Electrode as in claim 1, in which the at least one cooling element consists at least partly of copper columns having a configuration of an arc of a circle.

7. Electrode as in claim 1, in which the at least one cooling element consists at least partly of copper columns having a configuration of a ring.

8. Electrode as in claim 1, in which the at least one cooling element consists at least partly of copper columns having a spiral configuration.

9. Electrode as in claim 1, in which the at least one copper cooling element includes a roughened portion at an interface with the steel bar.

10. Electrode as in claim 1, in which the copper cooling elements has a vertical section shaped as a truncated cone.

11. Electrode as in claim 7, in which the height of the columns is between 10 mm. and 250 mm.

12. Electrode as in claim 1, in which the at least one copper cooling element is higher at an outer periphery of the bar.

13. Electrode as in claim 1, in which the cooling-water system includes a central discharge pipe within the at least one copper cooling element, an annular feeder pipe surrounding the central discharge pipe and an obligatory heat-exchange path provided between the annular feeder pipe and the central discharge pipe.

14. Electrode as in claim 13, in which a development conformed as an overturned bottom of a bottle used to contain sparkling wine is included between the annular feeder pipe and the obligatory path and has a cross-section of its passage with a height between 1.0 and 6.0 mm.

15. Electrode as in claim 13, in which the obligatory path includes separation baffles.

16. Electrode as in claim 13, in which the obligatory path has a spiral development.

17. Electrode as in claim 1, in which the at least one copper cooling element is solidly fixed to the lower part of the bar consisting of iron or an iron alloy.

* * * * *